US005771428A

United States Patent [19]

Marumoto et al.

[11] Patent Number: 5,771,428

[45] Date of Patent: Jun. 23, 1998

[54] IMAGE FORMING APPARATUS CAPABLE OF FACILITATING A JAM REMOVAL OPERATION

[75] Inventors: Takeshi Marumoto; Toru Nakayama, both of Osaka, Japan

[73] Assignee: Mita Industrial Co., Ltd., Osaka-fu, Japan

[21] Appl. No.: 889,171

[22] Filed: Jul. 7, 1997

[30] Foreign Application Priority Data

Jul. 9, 1996 [JP] Japan ..... 8-179598

[51] Int. Cl.[6] ..... G03G 15/00

[52] U.S. Cl. ..... 399/124; 399/21; 399/110

[58] Field of Search ..... 399/21, 124, 125, 399/110; 347/138, 152

[56] References Cited

U.S. PATENT DOCUMENTS 4,908,674 3/1990 Fukano et al. ..... 399/124

5,095,334 3/1992 Nukaya ..... 399/124 X 5,587,769 12/1996 Sawada et al. ..... 399/110 X

*Primary Examiner*—Matthew S. Smith

*Assistant Examiner*—Sophia S. Chen

*Attorney, Agent, or Firm*—Frank J. Jordan

[57] ABSTRACT

Disclosed is an image forming apparatus having the following arrangement. When a first linking member pivotally moves to the original position, an engaging portion juttingly formed from the first linking member engages a first positioning portion formed in a frame, while a second roller coming into contact with a first roller rotatably supported to the frame. A second linking member is pivotally rotated in response to the pivotal rotation of the first linking member, and part of a transfer unit engages a second positioning portion formed in the frame to position the transfer unit relative to a photosensitive drum. In association with the pivotal rotation of the second linking member, a guide portion of the second linking member engages part of a fixing unit to position the guide portion relative to the fixing unit.

6 Claims, 9 Drawing Sheets

IMAGE FORMING APPARATUS CAPABLE OF FACILITATING A JAM REMOVAL OPERATION

BACKGROUND OF THE INVENTION

1. Field of the Invention

This invention relates to an image forming apparatus such as a copying machine, and more particularly to an image forming apparatus capable of performing a jam removal operation (removing a jammed copy sheet) around a photosensitive drum.

2. Description of the Background Art

Generally, image forming apparatuses such as copying machines are constructed by assembling an optical system, an imaging unit with a photosensitive drum, a sheet transport unit and the other components. In such image forming apparatuses, an image in an original is formed onto a surface of a charged photosensitive drum to thereby form an electrostatic latent image on the drum surface. Thereafter, the latent image is developed into a toner image by a developing device. A copy sheet is transported by the sheet transport unit to a transfer device where the toner image is transferred thereon. The copy sheet having an image identical to the toner image is separated from the photosensitive drum by a separator portion and then transported to a fixing unit for image fixation.

In the image forming apparatus, when a copy sheet is jammed around the photosensitive drum, the jammed sheet is removed from the interior of the image forming apparatus in the following manner. Specifically, part of roller pairs constituting the sheet transport unit and a transfer unit comprising the transfer device and the separator device are integrally mounted on a common frame. When a copy sheet is jammed, an operator actuates a lever attached to a side of the frame upward or downward to lower one end of the frame. Thereupon, the transfer unit is away from the photosensitive drum to define a certain space (jam removal space) therebetween. The operator can remove the jammed copy sheet by pulling out the paper through the jam removal space. Upon completion of removing the jammed copy sheet, the operator moves the lever in the opposite direction to return the transfer unit in the initial state together with the frame. Then, the image forming apparatus is recovered to the initial state where image formation is enabled.

In the above-mentioned image forming apparatus so constructed as to remove a jammed paper, the jam removal space can be widened by making the other constituent members such as the sheet transport unit and the fixing unit movable altogether with the transfer unit toward and away from the photosensitive drum.

However, the greater the number of constituent parts movable at the same time, the lower the accuracy of returning all the parts at their respective initial positions, which becomes a hindrance to production of an image forming apparatus capable of securing a sheet transport path over an entire range from a sheet transport unit to a fixing unit along which a copy sheet is reliably transported in a state that all the parts are accurately positioned in the image forming apparatus, even after they are moved away from the photosensitive drum to remove a jammed copy sheet.

The conventional image forming apparatus has also suffered from another problem. Since various constituent members other than the transfer unit and the sheet transport unit are arranged below the frame to which the transfer unit and the sheet transport unit are mounted, it is difficult to obtain a large jam removal space, with the result that a jam removal operation becomes cumbersome.

SUMMARY OF THE INVENTION

A primary object of this invention is to provide an image forming apparatus capable of constantly establishing a sheet transport path from a sheet transport unit to a fixing unit along which a copy sheet is transported with high precision to perform an image formation in a steady state, while returning the sheet transport unit and a transfer unit to their respective initial positions with high positional accuracy, even after the transfer unit and part of the sheet transport unit are moved to perform a jam removal operation.

Another object of this invention is to provide an image forming apparatus capable of facilitating a jam removal operation by securing a larger jam removal space.

To accomplish the above objects, the present invention is directed to an apparatus for imaging an image onto a copy sheet. The apparatus comprises: a frame fixedly mounted to an interior of the apparatus, the frame having a first positioning portion and a second positioning portion; a sheet transport unit including a first roller rotatably supported to the frame and a second roller movable toward and away from the first roller to transport a copy sheet along a sheet transport direction while nipping the copy sheet with the first and second rollers; an imaging unit including a photosensitive drum rotatably mounted to the frame and a transfer unit movable between a retracted position away from the photosensitive drum and a transfer position where the copy sheet transported along the sheet transport direction from the sheet transport unit has the image transferable thereon at a transfer region of the photosensitive drum; a fixing unit for performing an image fixation onto the copy sheet transported along the sheet transport direction from the imaging unit; a first linking member pivotally rotatable about one end located upstream with respect to the sheet transport direction thereof between an original posture where an image formation is enabled and a jam removal posture where a jam removal operation is executable, the first linking member being mounted with the second roller rotatable at a portion other than the one end and formed with an engaging portion corresponding to the first positioning portion; and a second linking member having one end portion located upstream with respect to the sheet transport direction, the other end for guiding the copy sheet and a center portion for holding the transfer unit thereon, the one end portion being connected to the opposite end of the first linking member to be pivotally rotatable about the connecting portion in response to the pivotal rotation of the first linking member, wherein the engaging portion engaging the first positioning portion to allow the second roller to come into contact with the first roller, part of the transfer unit engaging the second positioning portion to position the transfer unit relative to the photosensitive drum, and the guide portion engaging part of the fixing unit to position the guide portion relative to the fixing unit, respectively when the first linking member pivotally shifts to the original posture.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
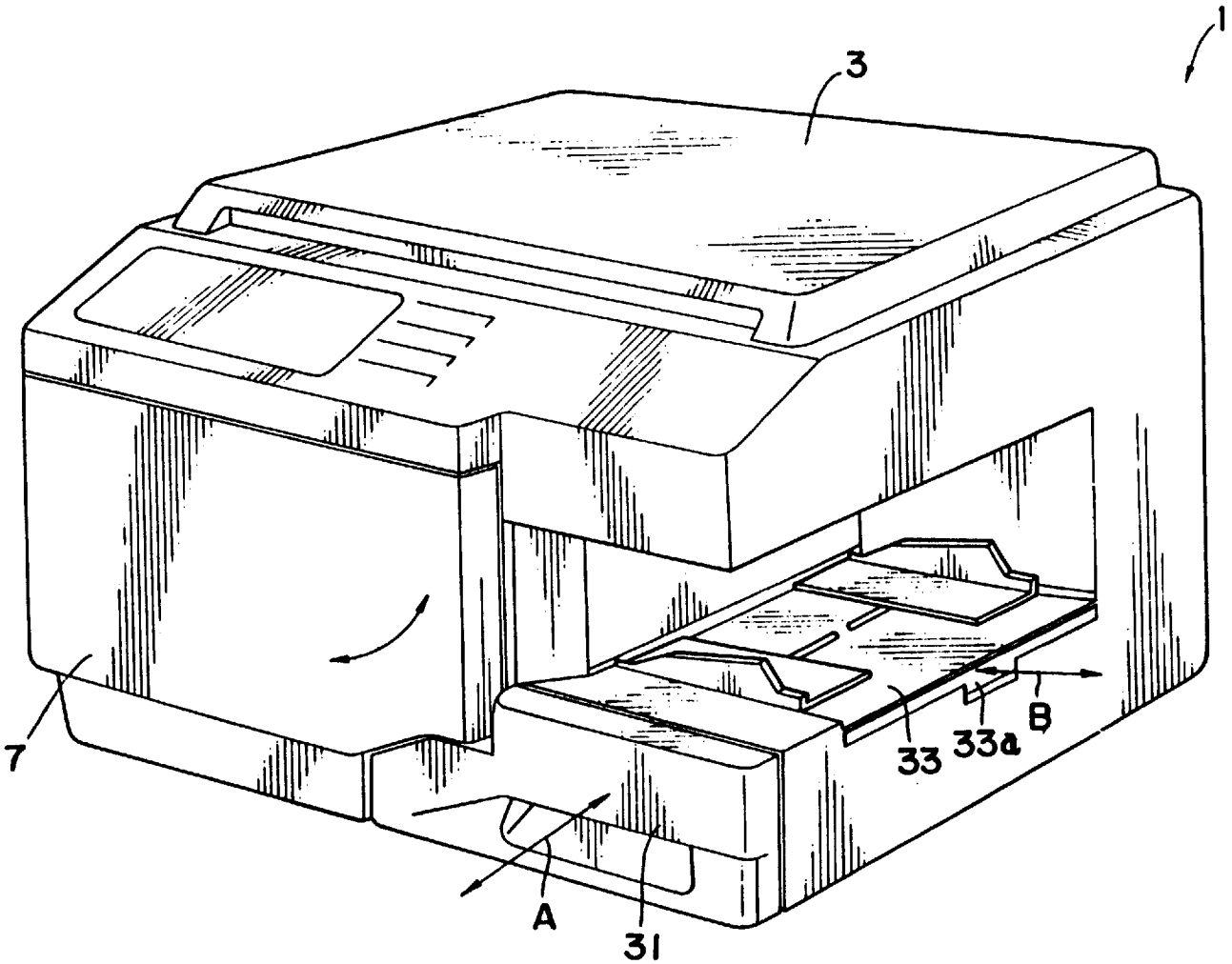
FIG. 1 is a perspective view of a copying machine as an embodiment of an image forming apparatus according to this invention.
Figure 2:
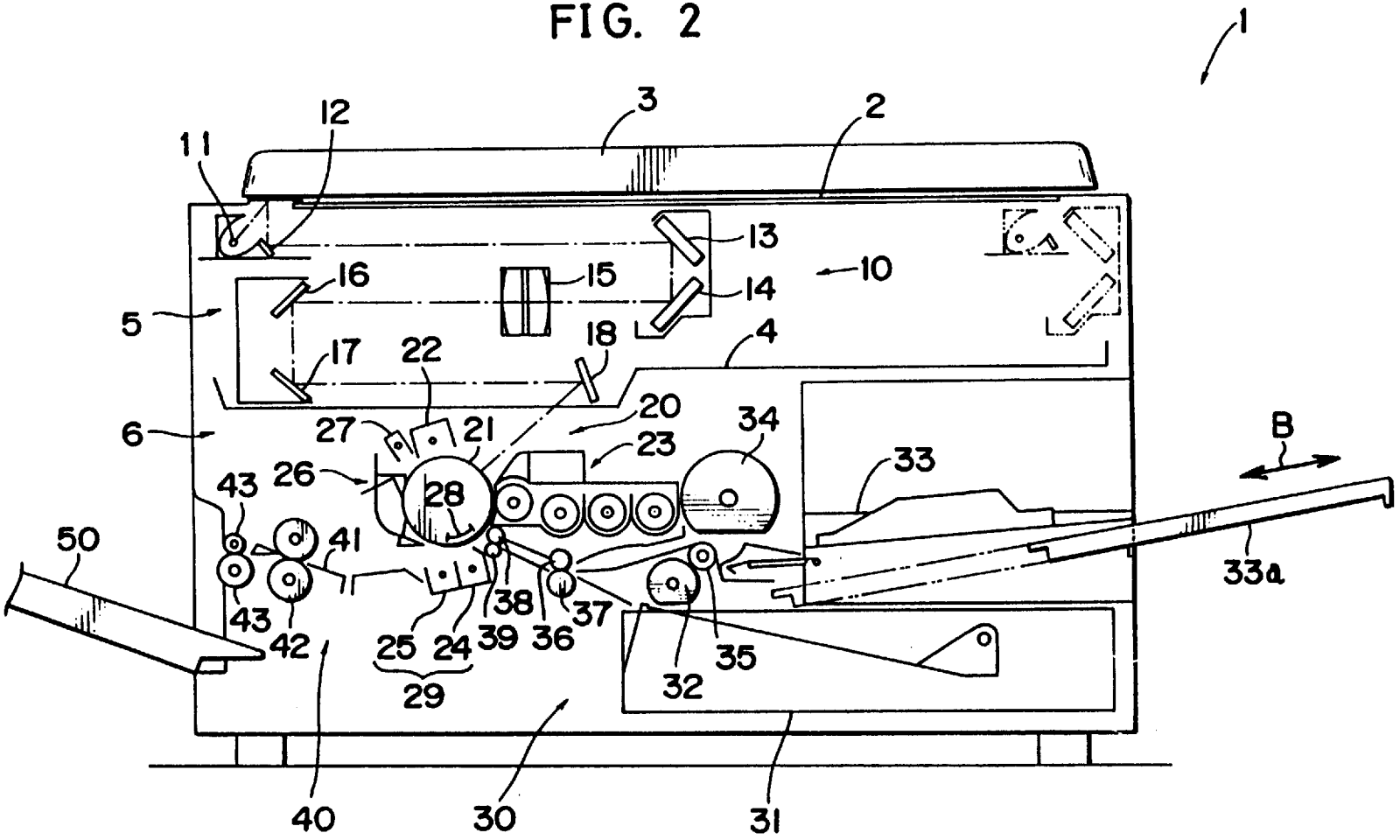
FIG. 2 is a diagram showing an interior arrangement of the copying machine.

FIG. 1 is a perspective view of a copying machine embodying this invention, and FIG. 2 is a diagram showing an interior arrangement of the copying machine.

Denoted at 1 is the copying machine. A contact glass 2 for placing an original thereon is fixedly mounted at a top of the copying machine 1. A document presser 3 is mounted openable with respect to the contact glass 2. When an original is placed on the contact glass 2, the document presser 3 is set to cover an entire plane of the contact glass 2, and a copy start key (not shown) is pressed, the copying machine 1 is entered into a copy enable state where the original image is copied on a copy sheet by operations of constituent members arranged inside the copying machine 1. The various constituent members will be described later in detail.

As shown in FIG. 2, there is provided a partition plate 4 inside the copying machine 1. With the partition plate 4, the inside of the copying machine is separated into two regions, i.e., upper space 5 and lower space 6. An optical unit 10 is arranged in the upper space 5, while an imaging unit 20, a sheet transport unit 30, and a fixing unit 40 are arranged in the lower space 6.

The optical unit 10 comprises an exposure lamp 11 functioning as an exposure light source. Light from the exposure lamp 11 illuminates a surface of the original placed on the contact glass 2. The optical unit 10 further comprises reflective mirrors 12 to 14 for guiding the light reflected from the original surface to a specified position, a lens 15 for imaging the light in the original onto a surface of a photosensitive drum to be described later, and reflective mirrors 16 to 18 through which the light from the original is guided toward the photosensitive drum. The exposure lamp 11 and the reflector 12 reciprocate integrally horizontally, while the reflective mirrors 13 and 14 integrally horizontally reciprocate in synchronism with the reciprocation of the exposure lamp 11 and the reflector 12, thereby conducting image scanning of the entire surface of the original.

The imaging unit 20 has the photosensitive drum 21 which is rotated in the clockwise direction on the plane in FIG. 2 at a constant speed by drive means (not shown). In the periphery of the photosensitive drum 21, there are arranged a main charger 22, a developing device 23, a transfer device 24, a separator device 25, a cleaner 26, and a blank lamp 27 from upstream side along the rotating direction of the drum 21 in this order.

After being charged uniformly by the main charger 22, a surface of the photosensitive drum 21 is exposed to the light from the original to form an electrostatic latent image thereon. The latent image is developed into a toner image by the developing device 23 while electrostatically attracting toner. Then, the toner image is transferred onto a copy sheet which is being transported to a transfer region of the photosensitive drum 21 by the transfer device 24. After being separated from the photosensitive drum 21 by the separator device 25, the copy sheet carrying the transferred toner image is guided to the fixing unit 40 to be described later.

It should be noted that the transfer device 24 is integrally movable with the separator device 25, between a transfer position where a toner image is transferable to a copy sheet transported from the sheet transport unit 30 on a transfer region 28 of the photosensitive drum 21 and a retracted position where the transfer device 24 (and the separator device 25) is retracted away from the photosensitive drum 21, which will be described later in detail.

A copy sheet is transported to the above constructed imaging unit 20 by the sheet transport unit 30 in the following manner. The sheet transport unit 30 has a sheet cassette 31 detachably mounted to the copying machine 1 along the direction of arrow A in FIG. 1 at a position corresponding to the front lower right portion of the copying machine 1 on the plane in FIG. 2. Copy sheet accommodated in the cassette 31 are fed one by one toward the imaging unit 20 by a feed roller 32 (see FIG. 2).

The sheet transport unit 30 has a manual insertion tray 33 with a guide plate 33*a* above the cassette 31. A copy sheet of any size can be set on the manual insertion tray 33 (and the guide plate 33*a*) desirably by sliding the guide plate 33*a* along the directions of arrow B according to the copy sheet size. The sheet transport unit 30 further has a pair of feed rollers 34, 35 on the side of the imaging unit 20 with respect to the manual insertion tray 33 to guidingly feed a copy sheet set on the manual insertion tray 33 (and the guide plate 33*a*) toward the imaging unit 20.

The sheet transport unit 30 is provided with a pair of transport roller (or upper and lower rollers) 36, 37 for transporting a copy sheet fed from the cassette 31 or via the manual insertion tray 33 toward the imaging unit 20, and a pair of registration rollers (or upper and lower rollers) 38, 39 for transporting the thus transported copy sheet further toward the imaging unit 20 in synchronism with formation of a latent image.

With the above arrangement, the copy sheet fed from the cassette 31 or via the manual insertion tray 33 is reliably transported to the imaging unit 20 by the feed roller 32, and rollers 34 to 39. After a latent image is transferred onto the copy sheet in the imaging unit 20, the copy sheet carrying the transferred image is transported toward the fixing unit 40. It should be appreciated that the upper rollers (or first rollers) 36 and 38 are fixedly mounted to a frame 60 of the copying machine 1 to be described later, whereas the lower rollers 37 and 39 are freely pivotable substantially vertically. The movement of the rollers 36 to 39 will be described later in detail.

The fixing unit 40 has a guide member 41. The copy sheet subjected to image transfer in the imaging unit 20 is transported to a fixing roller pair 42 along the guide member 41 for image fixation. Upon completion of an image fixation by the fixing roller pair 42, the copy sheet is discharged onto a discharge tray 50 mounted on a side of the copying machine 1 via a pair of discharge rollers 43.

A transport path along which a copy sheet is transported from the sheet transport unit 30 to the fixing unit 40 is described in detail hereinafter.

Figure 3:
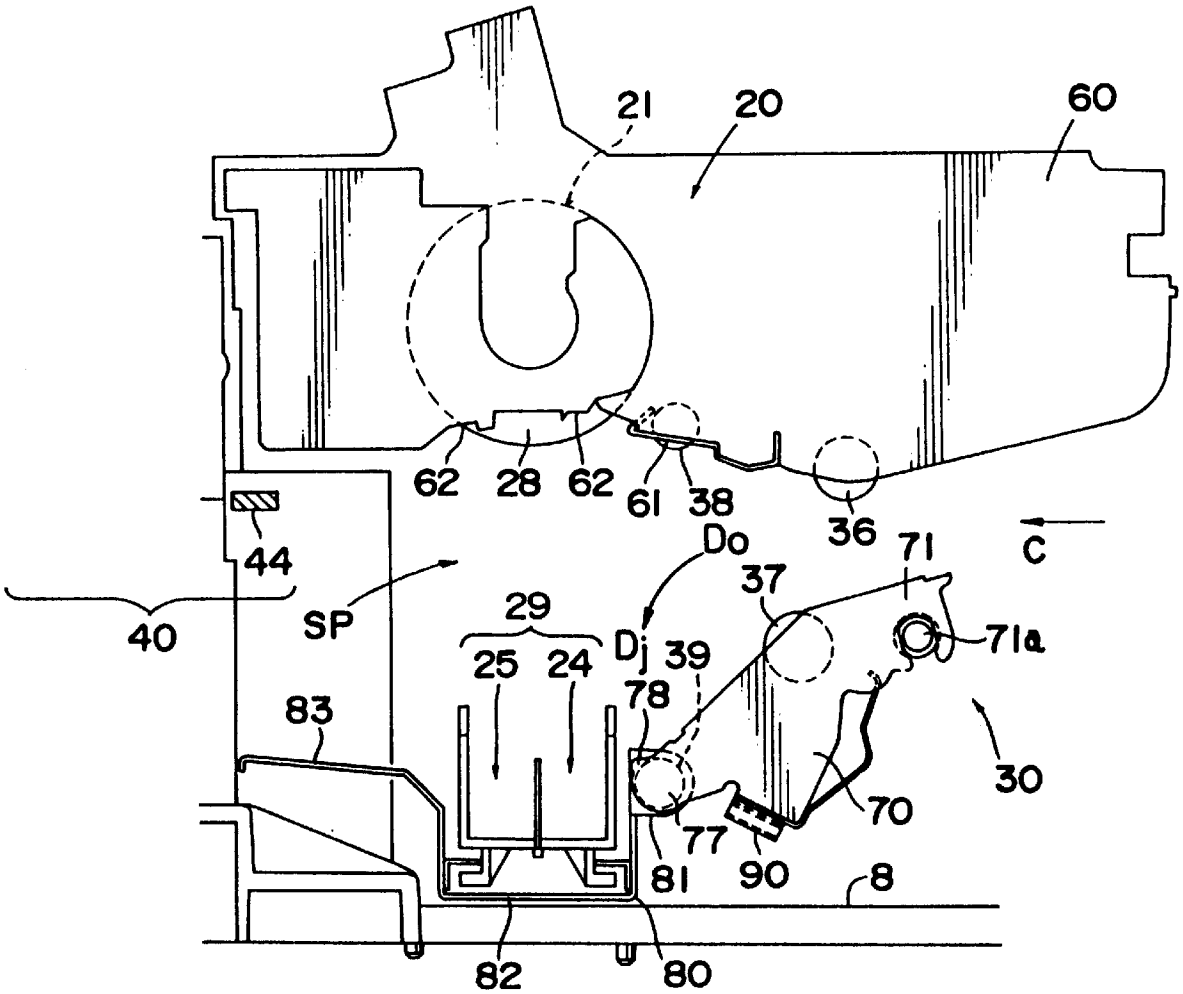
FIG. 3 is a partially enlarged view of the copying machine in a state that a first linking member is set to a jam removal posture.

FIG. 3 is a partially enlarged view of the copying machine in FIG. 2. The upper roller 36 of the transport roller pair and the upper roller 38 of the registration roller pair are rotatably supported to the frame 60, whereas the lower roller 37 of the transport roller pair and the lower roller 39 of the registration roller pair are supported to a first linking member 70. The first linking member 70 is pivotally movable at a lower side with respect to the frame 60. In response to a pivotal movement of the first linking member 70, the lower rollers 37 and 39 are moved toward and away from the upper rollers 36 and 38 respectively. When the lower rollers 37 and 39 come into contact with the upper rollers 36 and 38 respectively to nip the copy sheet therebetween in a state that these rollers are driven in the forward direction, the copy sheet is transported along the direction of arrow C.

The photosensitive drum 21 is rotatably mounted to the frame 60, as well as the upper rollers 36 and 38. Although not illustrated, the main charger 22, the developing device 23, the cleaner 26 and the blank lamp 27 are fixedly mounted to the frame 60 in such a manner that these members are arranged at an appropriate position in the periphery of the photosensitive drum 21. The transfer device 24 and the separator device 25 constituting a transfer unit 29 are disposed opposingly to the transfer region 28 of the photosensitive drum 21. As will be described later, the transfer unit 29 is movable between the transfer position and the retracted position while being supported to a second linking member 80 pivotally movable at a lower position of the photosensitive drum 21.

The frame 60 is further formed with a first positioning portion 61 to position the lower rollers 37 and 39 relative to the upper rollers 36 and 38 and a second positioning portion 62 to position the transfer unit 29 relative to the photosensitive drum 21, respectively.

Figure 4:
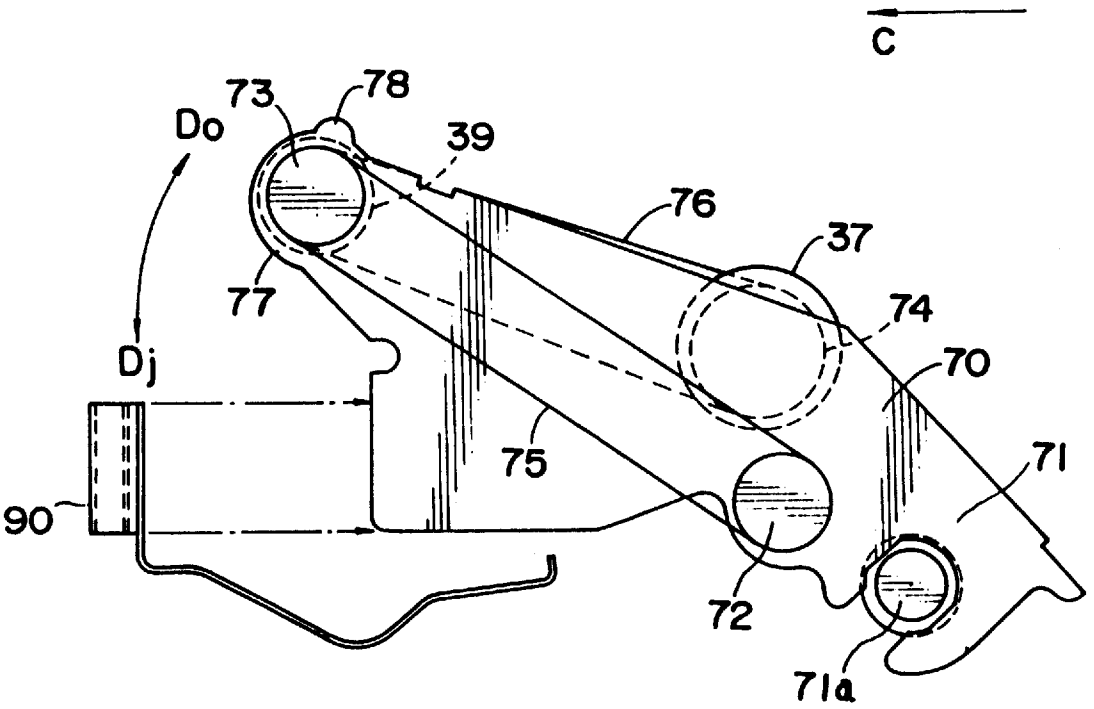
FIG. 4 is a diagram showing the first linking member.

FIG. 4 is a diagram of the first linking member 70 showing a state that the member 70 is set to an original position (original posture) where an image formation is enabled. As shown in this figure, the first linking member 70 is mounted with a pivot axis 71*a* at one end 71, located upstream with respect to the sheet transport direction C (in FIG. 2, right-hand side). The first linking member 70 is pivotally rotatable about the pivot axis 71*a* in the arrow directions D in FIG. 4. Specifically, when rotated in the arrow direction Do, the first linking member 70 is returned to the original posture, whereas rotated in the arrow direction Dj, the first linking member 70 is shifted to a jam removal posture where removal of a jammed copy sheet is enabled.

The transport roller 37 is rotatably supported at a substantially upper middle portion of the first linking member 70, while the registration roller 39 is rotatably supported at the opposite end 77 of the first linking member 70. The first linking member 70 is further mounted with a pulley 72 at an appropriate position below a mounting position of the transport roller 37 to the link member 70, a pulley 73 coaxially rotatable with the registration roller 39, and a pulley 74 coaxially rotatable with the transport roller 37. Belts 75 and 76 are stretched between the pulleys 72, 73 and between the pulleys 73, 74, respectively. Upon activation of a motor (not shown) coupled to the pulley 72, the rollers 37 and 39 are started rotating.

The opposite end 77 is formed with an engaging portion 78 jutting upward. The engaging portion 78 has a shape engageable with the first positioning portion 61. The first linking member 70 is attached with an elastic member 90. The function of the elastic member 90 will be described later.

Referring back to FIG. 3, the arrangement of the second linking member 80 is described. The second linking member 80 has one end 81, located upstream with respect to the sheet transport direction C. The second linking member 80 is connected to the first linking member 70 in such a manner that the one end 81 is connected to the opposite end 77 of the first linking member 70, and is pivotable about the connecting portion of the first and second linking members 70 and 80 in response to a pivotal movement of the first linking member 70. Specific movements of the second linking member 80 in association with movements of the first linking member 70 will be described later in detail.

The transfer unit 29 is supported by a spring (not shown) which locates on a center portion 82 of the second linking member 80. With the spring force from the spring, the transfer unit 29 is held on the second linking member 80 while having horizontal moving latitude. The opposite end 83 of the second linking member 80 extends toward the fixing unit 40 to serve as a guide member for guidingly transporting a copy sheet to the fixing unit 40. In this embodiment, the opposite end 83 of the second linking member 80 is molded into such a shape as to serve as guide means. Alternatively, a guide plate of a desirable shape may be provided independently of the second linking member 80 and be connected to the opposite end 83 of the second linking member 80 to guide a copy sheet.

Figure 5:
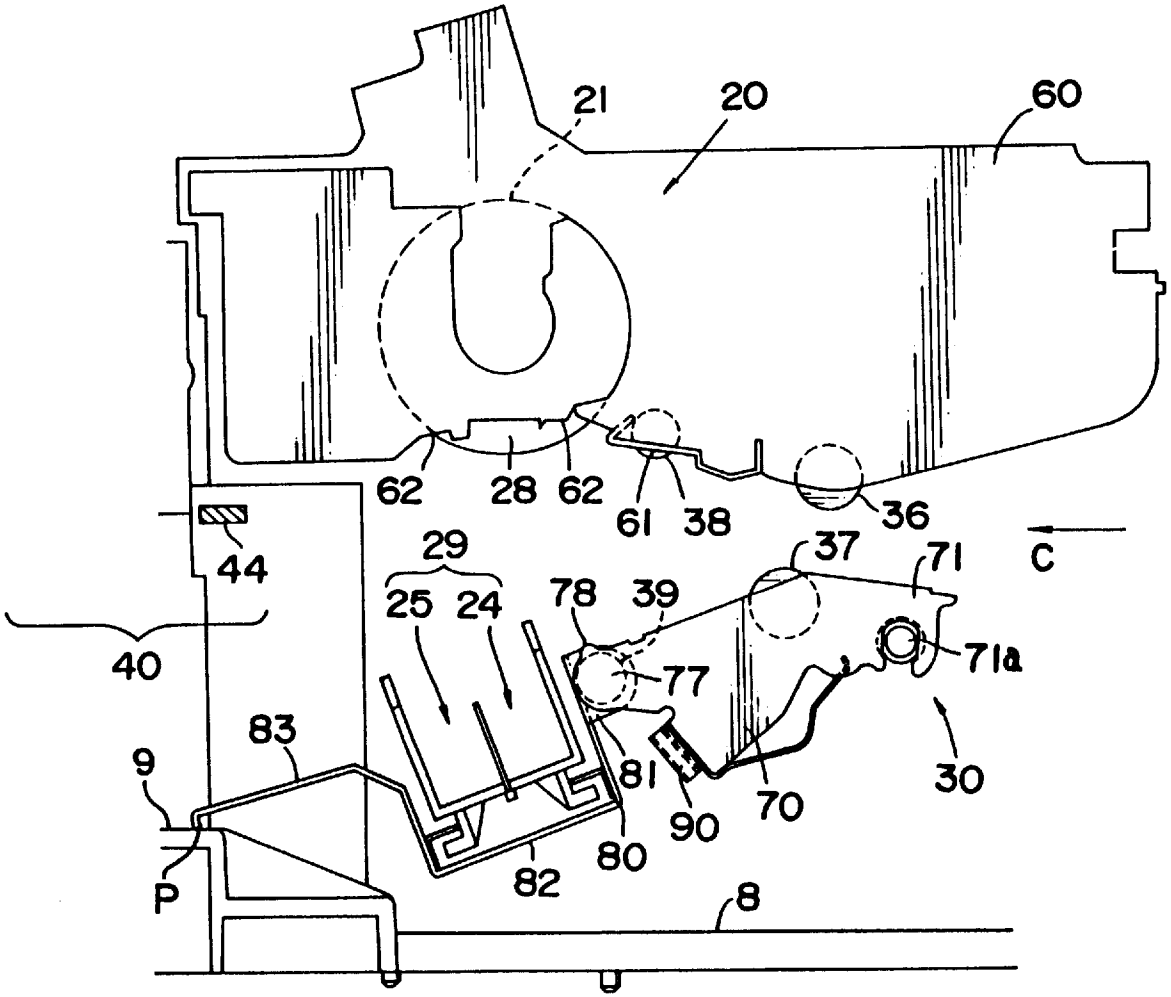
FIG. 5 is a partially enlarged view of the copying machine in a state that the first linking member is on the way between the jam removal posture and an original posture.

It should be appreciated that in FIG. 5, a member denoted at reference numeral 44 is part of the fixing unit 40 and serves as a positioning member for positioning the guide portion 83 relative to the fixing unit 40, which will be described later.

Next, a jam removal operation and initiation of image formation after the jam removal will be described with reference to FIGS. 3, and 5 to 7.

When a copy sheet is jammed in the copying machine 1, an operator opens a front panel 7 (see FIG. 1) of the copying machine 1, and operates a lever (not shown) coupled to the pivot axis 71*a* to pivotally rotate the first linking member 70 about the pivot axis 71*a* in the direction Dj, thereby setting the first linking member 70 to the jam removal posture. At the same time of the pivotal movement of the first linking member 70, the second linking member 80 is pivotally rotated about the connecting portion to be placed on a bottom 8 of the copying machine 1. Thereupon, as shown in FIG. 3, the transfer unit 29 and the guide portion 83 of the second linking member 80 are moved greatly away from the photosensitive drum 21 to define a large jam removal space SP between the photosensitive drum 21 and the transfer unit 29 and the sheet transport unit 30. Thus, the operator can perform jam removal operation easily inside the jam removal space SP. It should be noted that the posture of transfer unit 29 shown in FIG. 3 corresponds to the "retracted position" of the transfer unit 29.

Upon finish of the jam removal operation, the operator returns the lever to the initial state so as to return the first linking member 70 to the original posture (shown by the "original position" in FIG. 7 to be described later) where an image formation is enabled. Hereinafter, movements of the first and second linking members 70, 80 until the first linking member 70 is returned to the original position will be described in detail with reference to FIGS. 5 to 7.

After a certain time from a rotation of the first linking member 70 in the direction Do to set the first linking member 70 to the original posture is started with actuation of the unillustrated lever, a lead end of the guide portion 83 of the second linking member 80 comes into contact with a structure frame 9 attached to the bottom 8 of the copying machine 1 at a contact point P. Upon contact of the structure frame 9, the one end 81 of the second linking member 80 is lifted up in a state that the contact point P serves as a fulcrum, while raising the transfer unit 29 supported on the second linking member 80 at the intermediate portion 82 upward departing from the bottom 8 (see FIG. 5).

Figure 6:
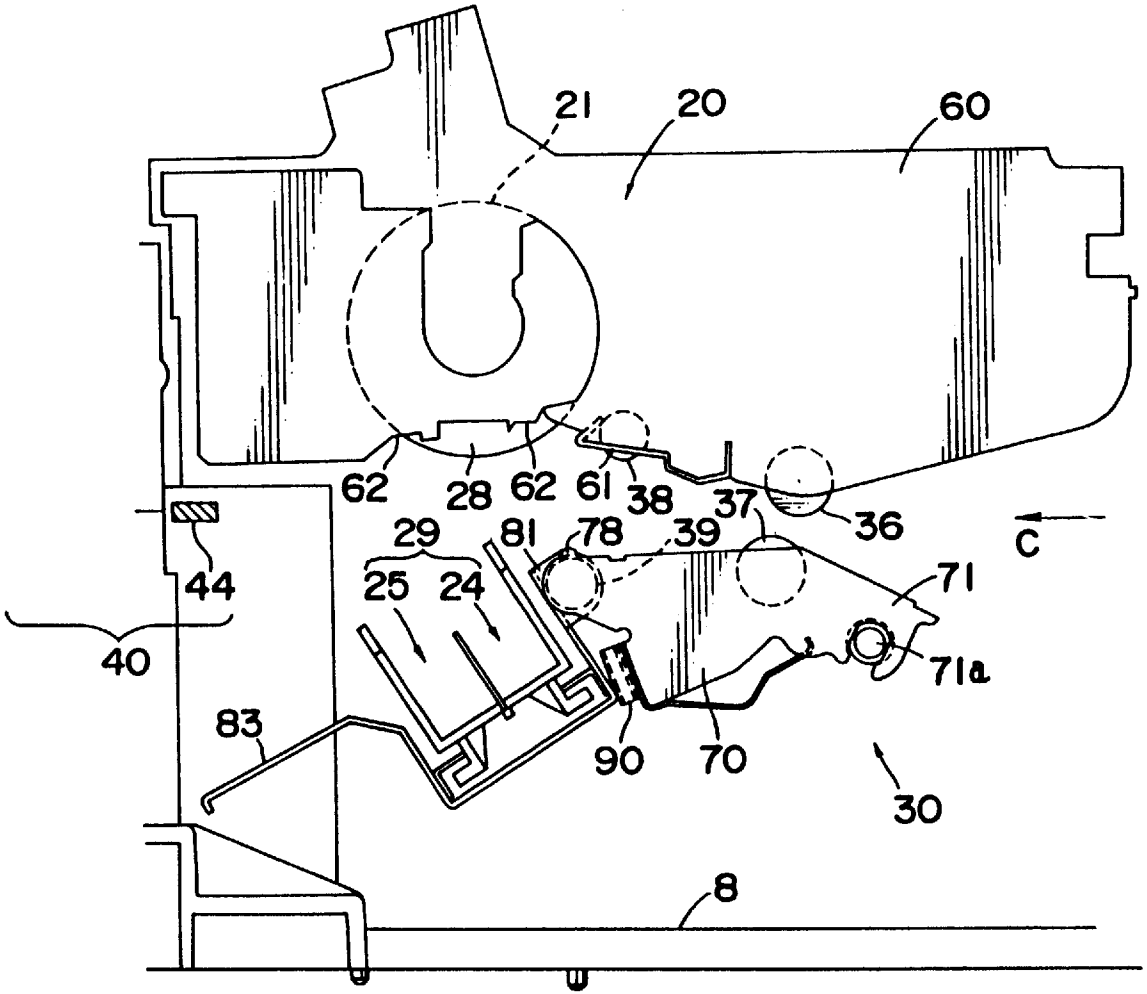
FIG. 6 is a partially enlarged view of the copying machine in a state that the first linking member is on the way between the jam removal posture and the original posture.

As the pivotal movement of the first linking member 70 in the direction Do is proceeded, as shown in FIG. 6, the elastic member 90 mounted to the first linking member 70 is abutted against the second linking member 80. Thereby, a pressing force of the first linking member 70 acting on the second linking member 80 and an urging force of the elastic member 90 generated by pressing contact with the second linking member 80 result in lifting the second linking member 80 together with the transfer unit 29 upward toward the photosensitive drum 21. Also, as the pivotal movement of the first linking member 70 is proceeded, the guide portion 83 departs from the structure member 9 and is raised upward toward the member 44 of the fixing unit 40.

Figure 7:
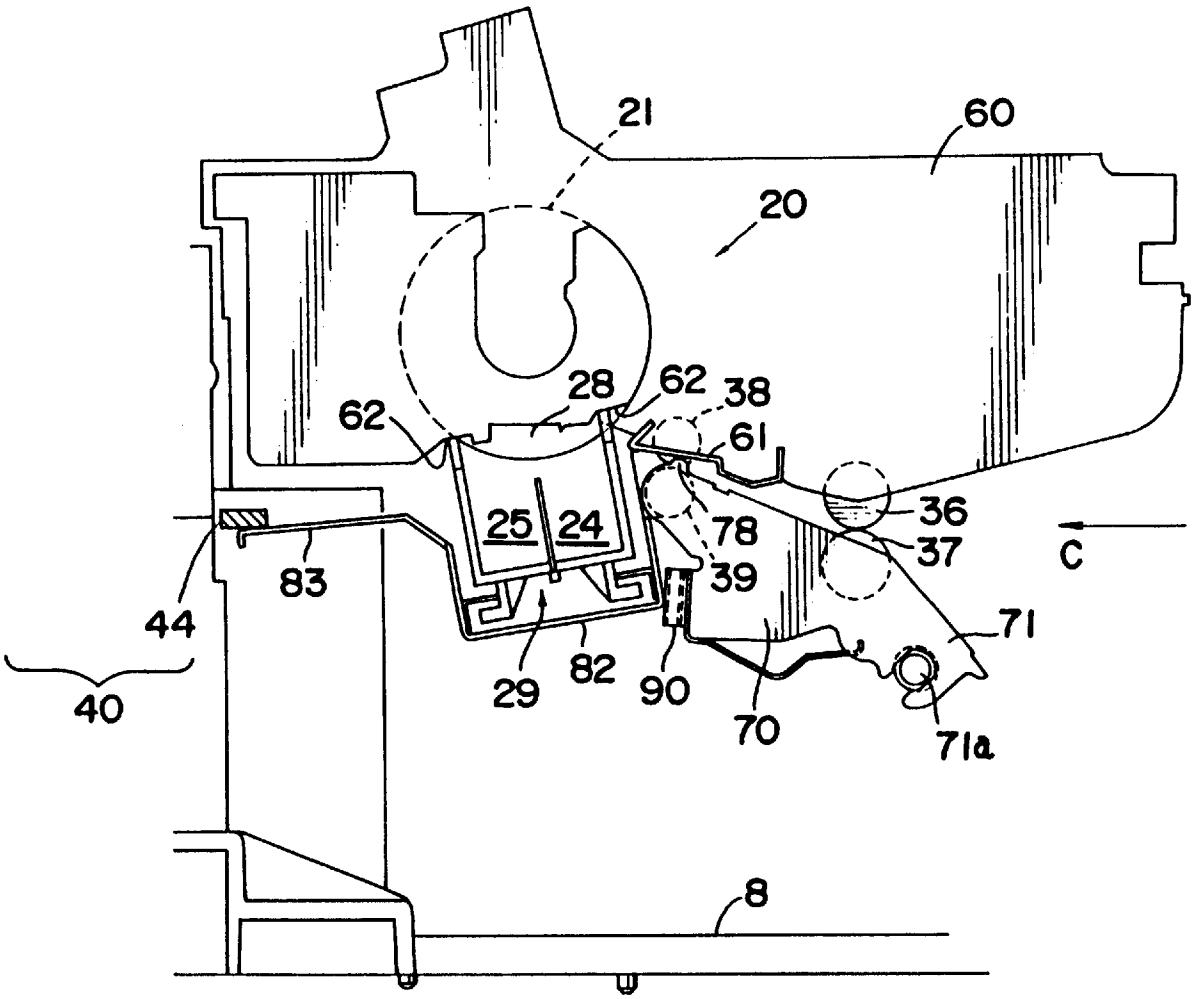
FIG. 7 is a partially enlarged view of the copying machine in a state that the first linking member is set to the original posture.

When the first linking member 70 is returned to the original position (set to the original posture) as shown in FIG. 7, the transport roller 37, the registration roller 39, the transfer unit 29, and the guide portion 83 are positioned to their respective original positions in the following manner. Specifically, when the first linking member 70 is rotated in the direction Do toward the original position, the engaging portion 78 of the first linking member 70 is engaged with the first positioning portion 61 of the frame 60. At the same time, the transport roller 37 and registration roller 39 respectively come into contact with the transport roller 36 and registration roller 38 fixedly mounted to the frame 60, and are exactly positioned thereat.

Thereby, a copy sheet can be reliably transported toward the imaging unit 20 in a state that it is nipped between the transport rollers 36 and 37 and between the registration rollers 38 and 39.

Referring back to the transfer unit 29 which is held on the center portion 82 of the second linking member 80 with the horizontal moving latitude, when the first linking member 70 is set to the original posture, an upper end of the transfer unit 29 is fitted to the second positioning portion 62 formed in the frame 60 to be accurately positioned relative to the photosensitive drum 21.

Further, since the elastic member 90 comes into pressing contact with the second linking member 80 to urge the transfer unit 29 toward the photosensitive drum 21, as shown in FIG. 7, the following advantages are obtainable. Since main components of the transfer unit 29 are made of a metallic material, the transfer unit 29 as a whole has a relatively heavy weight. Accordingly, there may be a drawback that the transfer unit 29 slants downward with the self weight and is displaced from the transfer position. To eliminate such drawback, the elastic member 90 serves as urging means to urge the transfer unit 29 located at the transfer position toward the photosensitive drum 21. Thereby, a positional displacement of the transfer unit 29 can be effectively prevented.

Accompanied by lifting up and pivotal rotation of the second linking member 80, the guide portion 83 is lifted up and positioned in engagement with the member 44 constituting the fixing unit 40. Thus, when the guide portion 83 is positioned relative to the fixing unit 40, the transport path is established to transport the copy sheet having been finished with image transfer in the transfer unit 29 up to the fixing unit 40 in a steady state while being guided along the guide portion 83. Thereby, an image fixation onto the copy sheet can be stably executed by the fixing unit 40.

As mentioned above, in order to facilitate a jam removal operation, the transport roller 37, the registration roller 39, the transfer unit 29 and the guide portion 83 are movable downward to define a large space. On the other hand, despite the large movement of these parts, these parts can be accurately returned to their respective initial positions where an image transfer is enabled after a jam removal. Thus, an image formation in a steady state can be performed, while securing the transport path from the sheet transport unit 30 to the fixing unit 40 with high positional accuracy.

In this embodiment, the first and second linking members 70 and 80, the lower (second) rollers 37 and 39 of the transport roller pair and the registration roller pair, the transfer unit 29, and the guide portion 83 are located below the photosensitive drum 21. Accordingly, when the first linking member 70 is rotated in the direction Dj toward the jam removal position, the first and second linking members 70, 80, second rollers 37, 39, transfer unit 29, and guide portion 83 are moved greatly away from the photosensitive drum 21, and from the first rollers 36, 38 to define the large jam removal space SP.

In the above embodiment, the elastic member 90 urges the transfer unit 29 at the transfer position toward the photosensitive drum 21. However, such urging means is not an essentially element. A portion of the first linking member 70 may serve as urging means to directly urge the second linking member 80 toward the photosensitive drum 21.

Figure 8:
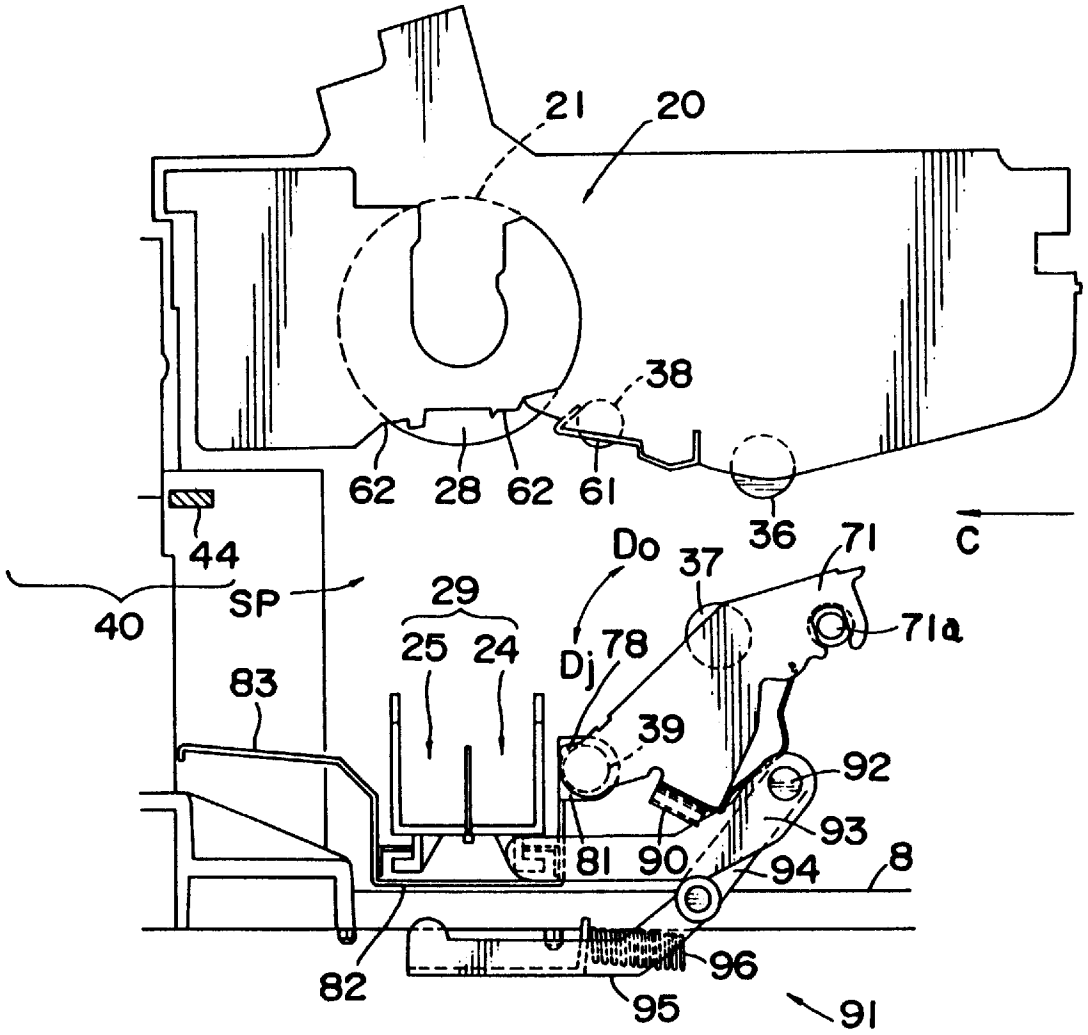
FIG. 8 is a diagram showing an interior enlarged construction of the image forming apparatus as an altered form in a state that the first linking member is set to the jam removal posture.
Figure 9:
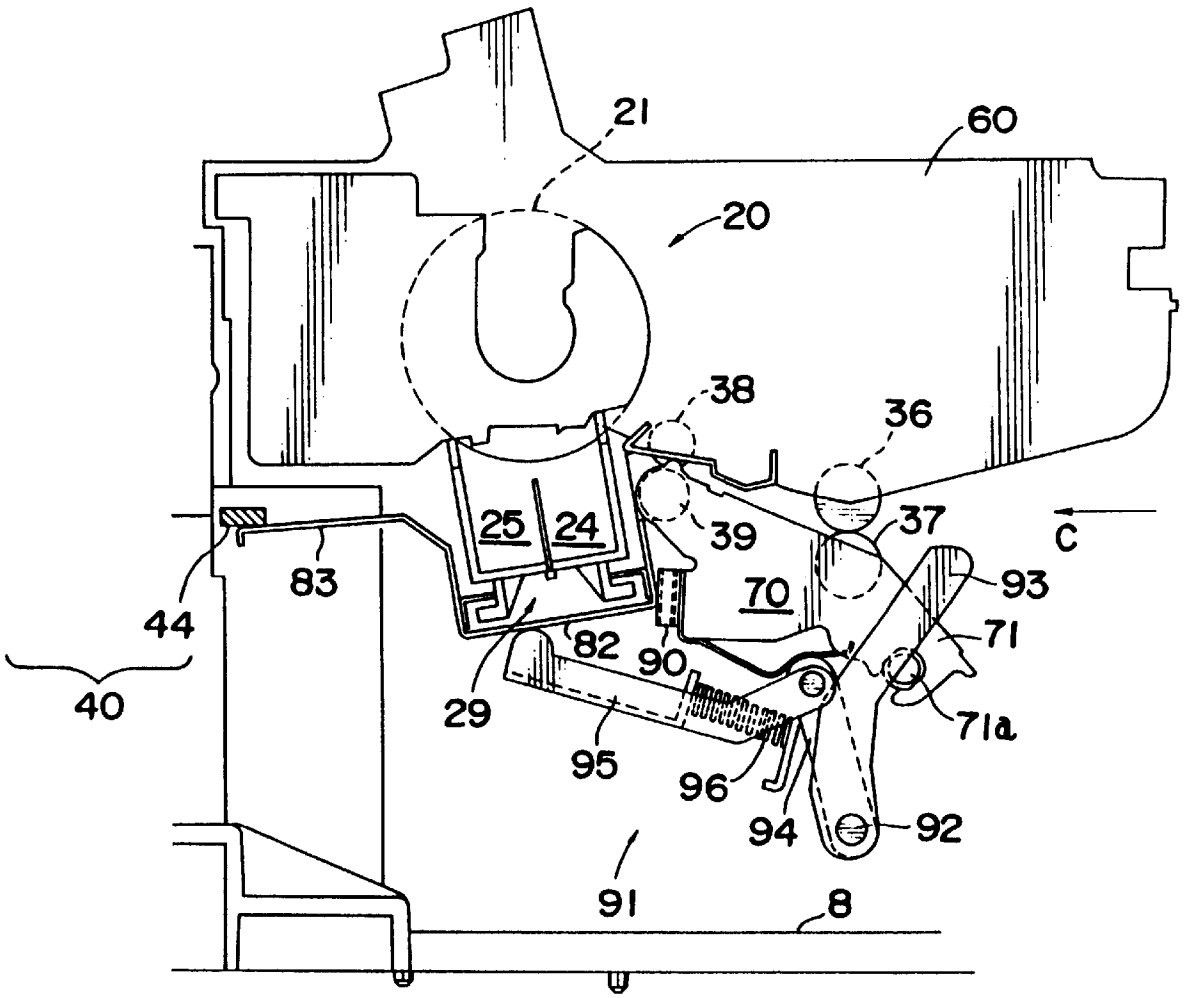
FIG. 9 is a diagram showing an interior enlarged contruction of the altered image forming apparatus in a state that the first linking member is set to the original posture.

In addition to the elastic member 90, an urging mechanism shown in FIGS. 8 and 9 may be added to the urging means. With this arrangement, a larger urging force is acted on the transfer unit 29. This increases positional accuracy even though the size of transfer unit 29 becomes larger.

FIGS. 8 and 9 are partially enlarged interior views of an altered form of the copying machine according to this invention provided with the urging mechanism to urge the transfer unit toward the photosensitive drum. Specifically, FIG. 8 shows a state of the urging mechanism when the first linking member 70 is set to the jam removal posture, whereas FIG. 9 shows a state of the urging mechanism when the first linking member 70 is set to the original posture.

Reference numeral 91 denotes the urging mechanism. The urging mechanism 91 is provided with a lever 93 freely rotatable about a pivot axis 92. The urging mechanism 91 has a link member 94 with one end coupled to the lever 93 at a specified position, and the opposite end coupled to one end of a support member 95. Although, in this altered form, a lever is not provided at the one end 71 of the first linking member 70, the first linking member 70 is pivotally rotatable about the pivot axis 71*a* in response to an actuation of the lever 93.

A jam removal operation and recovering operation of the copying machine of this altered form after the jam removal are described with reference to FIGS. 8 and 9.

When a copy sheet is jammed in the copying machine 1, an operator opens the front panel 7 (see FIG. 1) of the copying machine, and actuates the lever 93 in the arrow direction Dj to pivotally rotate the link member 94 about the pivot axis 92 in the arrow direction Dj. Accompanied by the pivotal rotation of the link member 94, the first linking member 70 is moved to the jam removal posture. Similar to the above embodiment, when the first linking member 70 is moved to the jam removal posture, the second linking member 80, the transport roller 37, the registration roller 39, the transfer unit 29 and the guide portion 83 are moved greatly downward away from the photosensitive drum 21 to define the large jam removal space SP. At this time, the support portion 95 coupled to the link member 94 is also moved downward and retracted from the jam removal space SP so as not to obstruct a jam removal operation in the jam removal space SP.

When the operator actuates the lever 93 in the recovering direction Do opposite to the jam removal direction Dj to return the first linking member 70 to the original posture after the jam removal operation, the link member 94 is pivotally rotated in the same direction as the recovering direction of the lever 93. Thereby, the link member 94 pivotally rotates the entirety of the first linking member 70 about the pivot axis 71*a* in the same direction as the rotating direction (recovering direction Do) of the lever 93, while the connecting portion between the support portion 95 and the link member 94 coming into pressing contact with part of the elastic member 90, thereby returning the first linking member 70 to the original posture.

Thus, similar to the aforementioned embodiment, when the first linking member 70 is returned to the original posture after a jam removal operation, the sheet transport path from the sheet transport unit 30 to the fixing unit 40 can be established with high positional accuracy in a state that the transport roller 37, the registration roller 39, the transfer unit 29, and the guide portion 83 are reliably returned to their respective initial positions. Thereby, an image formation in a steady state can be carried out.

In the above altered form, in response to a pivotal rotation of the link member 94 in the direction Do, a lead end (bulging portion) of the support portion 95 comes into contact with a bottom surface of the second linking member 80 to urge the second linking member 80 toward the photosensitive drum 21 by an elastic force of a spring 96. Accordingly, the transfer unit 29 is given an urging force applied from the urging mechanism 91, in addition to the urging force of the elastic member 90, thereby increasing positional accuracy of the transfer unit 29 relative to the photosensitive drum 21 when the first linking member 70 is set to the original posture.

In the above altered form, the urging means comprises the elastic member 90 and the urging mechanism 91. Alternatively, the urging means may consist solely of the urging mechanism 91.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An apparatus for imaging an image onto a copy sheet, said apparatus comprising:

a frame fixedly mounted to an interior of the apparatus, said frame having a first positioning portion and a second positioning portion;

a sheet transport unit including a first roller rotatably supported to said frame and a second roller movable toward and away from said first roller to transport a copy sheet along a sheet transport direction while nipping the copy sheet with said first and second rollers;

an imaging unit including a photosensitive drum rotatably mounted to said frame and a transfer unit movable between a retracted position away from said photosensitive drum and a transfer position where the copy sheet transported along the sheet transport direction from said sheet transport unit has the image transferable thereon at a transfer region of said photosensitive drum;

a fixing unit for performing an image fixation onto the copy sheet transported along the sheet transport direction from said imaging unit;

a first linking member pivotally rotatable about one end located upstream with respect to the sheet transport direction thereof between an original posture where an image formation is enabled and a jam removal posture where a jam removal operation is executable, said first linking member being mounted with the second roller rotatable at a portion other than the one end and formed with an engaging portion corresponding to the first positioning portion; and a second linking member having one end portion located upstream with respect to the sheet transport direction, the other end having a guide portion for guiding the copy sheet and a center portion for holding said transfer unit thereon, said one end portion being connected to an opposite end of said first linking member to be pivotally rotatable about the connecting portion in response to the pivotal rotation of said first linking member, wherein the engaging portion engaging the first positioning portion to allow the second roller to come into contact with the first roller, part of said transfer unit engaging the second positioning portion to position said transfer unit relative to said photosensitive drum, and the guide portion engaging part of the fixing unit to position the guide portion relative to the fixing unit, respectively when said first linking member pivotally shifts to the original posture.

2. An image forming apparatus according to claim 1, further comprising urging means for urging said transfer unit toward said photosensitive drum when said transfer unit is set at the transfer position.

3. An image forming apparatus according to claim 2, wherein said urging means is attached to said first linking member and comes into pressing contact with said second linking member when said first linking member is set to the original posture, said urging means includes an elastic member for urging said second linking member toward said photosensitive drum.

4. An image forming apparatus according to claim 2, wherein said urging means includes an urging mechanism with a support portion, said urging mechanism is movable toward and away from said second linking member in association with the pivotal rotation of said first and second linking members, and the support portion comes into pressing contact with said second linking member when said first linking member shifts to the original posture to urge said second linking member toward said photosensitive drum.

5. An image forming apparatus according to claim 1, wherein said first linking member, said second linking member, the second roller, said transfer unit, and the guide portion are arranged below said photosensitive drum.

6. An image forming apparatus according to claim 5, wherein said second linking member, said transfer unit, and the guide portion are integrally located at a bottom of the interior of the apparatus when said first linking member moves to the jam removal posture.

* * * * *